US008959949B2

(12) United States Patent
Fujisaku et al.

(10) Patent No.: US 8,959,949 B2
(45) Date of Patent: Feb. 24, 2015

(54) TURBO COMPRESSOR

(75) Inventors: Katsuya Fujisaku, Yokohama (JP); Noriyasu Sugitani, Yokohama (JP)

(73) Assignee: IHI Corporation (JP)

( * ) Notice: Subject to any disclaimer, the term of this patent is extended or adjusted under 35 U.S.C. 154(b) by 995 days.

(21) Appl. No.: 13/079,906

(22) Filed: Apr. 5, 2011

(65) Prior Publication Data

US 2011/0239693 A1 Oct. 6, 2011

(30) Foreign Application Priority Data

Apr. 6, 2010 (JP) ..... P2010-087858

(51) Int. Cl.
*F04D 5/00* (2006.01)
*F04D 29/053* (2006.01)
*F04D 25/04* (2006.01)

(52) U.S. Cl.
CPC ..... *F04D 29/053* (2013.01); *F04D 25/04* (2013.01)
USPC ..... 62/498; 415/53.3; 418/259

(58) Field of Classification Search
USPC ..... 415/208.1, 53.3; 418/225–227, 259; 464/23
See application file for complete search history.

(56) References Cited

U.S. PATENT DOCUMENTS

| | | | | |
|---|---|---|---|---|
| 6,634,865 | B2 * | 10/2003 | Dalton | 417/220 |
| 2004/0205966 | A1 | 10/2004 | Ohishi | 29/889.2 |

FOREIGN PATENT DOCUMENTS

| | | | |
|---|---|---|---|
| CN | 1740565 | A | 3/2006 |
| CN | 101258331 | A | 9/2008 |
| CN | 101349258 | A | 1/2009 |
| CN | 101504002 | A | 8/2009 |
| CN | 101526090 | A | 9/2009 |
| CN | 201326572 | Y | 10/2009 |
| CN | 101644501 | A | 2/2010 |
| JP | 62-243997 | | 10/1987 |
| JP | 11-270872 | | 10/1999 |
| JP | 2000-291587 | | 10/2000 |
| JP | 2006-233899 | | 9/2006 |
| JP | 2007-177695 | | 7/2007 |
| WO | WO 2008/007685 | | 1/2008 |

OTHER PUBLICATIONS

Office Action dated Feb. 28, 2013 issued in corresponding Chinese Patent Application No. 201110083542.6 with English translation.
Office Action dated Oct. 12, 2013 issued in corresponding Chinese Application No. 201110083542.6 (with English translation).
Notice of Allowance dated Oct. 29, 2013 issued in corresponding Japanese Application No. 2010-087858 (with English translation).

* cited by examiner

*Primary Examiner* — Cassey D Bauer
(74) *Attorney, Agent, or Firm* — Ostrolenk Faber LLP

(57) ABSTRACT

Provided is a drive shaft structure including: a drive shaft which transmits the drive force; and a seal member which is provided to come into close contact with the outer peripheral surface of the drive shaft. In the drive shaft structure, the drive shaft includes a second surface located closer to the inner side of the radial direction than the outer peripheral surface, and the second surface includes an index mark used to confirm information on the rotation of the drive shaft or information on the displacement thereof in the axial direction.

8 Claims, 4 Drawing Sheets

TURBO COMPRESSOR

BACKGROUND OF THE INVENTION

1. Field of the Invention

The present invention relates to a drive shaft structure, a turbo compressor, and a turbo refrigerator.

Priority is claimed on Japanese Patent Application No. 2010-087858, filed Apr. 6, 2010, the content of which is incorporated herein by reference.

2. Background Art

As a refrigerator cooling or freezing a cooling object such as water, there has been known a turbo refrigerator including a turbo compressor compressing and discharging a refrigerant gas. This kind of turbo compressor may include a flow rate control unit that adjusts the flow rate of a refrigerant gas flowing inside the turbo compressor in order to adjust the cooling capability of the turbo refrigerator (for example, refer to Japanese Patent Application, First Publication No. 2007-177695). The flow rate control unit is provided inside the casing of the turbo compressor, and the flow rate control unit may adjust the passage width of the refrigerant gas is adjusted or use a plurality of blade members rotatably provided inside the passage of the refrigerant gas. A drive unit, such as a motor for driving the flow rate control unit, is provided at the outside of the casing. The drive unit is connected to the flow rate control unit through a drive shaft. The drive shaft is a shaft member that transmits the drive force generated by the drive unit to the flow rate control unit. Since the drive shaft is provided so as to penetrate the casing, a seal member (packing or the like) is provided while coming into close contact with the outer peripheral surface of the drive shaft so as to prevent the refrigerant gas from leaking from the periphery of the drive shaft.

In the turbo refrigerator, since the flow rate control unit is provided inside the casing of the turbo compressor, it is difficult to confirm the operation thereof from the outside of the casing. For this reason, an index mark may be formed at a visible position of the outer peripheral surface of the drive shaft so as to confirm and inspect the operation of the flow rate control unit. The index mark may be formed by, for example, a punch.

However, when the index mark is formed by the punch, burrs are formed around the index mark. Further, it is necessary to disassemble and assemble again the drive shaft and the seal member to confirm the interior of the turbo compressor during, for example, maintenance.

That is, since the seal member is provided while coming into close contact with the outer peripheral surface of the drive shaft, there is a possibility that the seal member is damaged due to burrs upon disassembling or assembling the drive shaft and the seal member when burrs are formed at the outer peripheral surface due to the index mark. Since the air-tightness around the drive shaft may not be ensured when the seal member is damaged, the damaged seal member needs to be replaced with new one. Therefore, there is a problem in that maintenance cost of the turbo compressor increases.

The invention is made in view of such circumstances, and an object thereof is to provide a drive shaft structure capable of preventing the seal member from being damaged upon disassembling and assembling the drive shaft and the seal member, a turbo compressor, and a turbo refrigerator.

SUMMARY OF THE INVENTION

In order to solve the above-described problems, the invention adopts the following configurations.

(1) A drive shaft structure according to an aspect of the invention includes: a drive shaft which transmits the drive force; and a seal member which is provided to come into close contact with the outer peripheral surface of the drive shaft. The drive shaft includes a second surface located closer to the inner side of the radial direction than the outer peripheral surface, and the second surface includes an index mark used to confirm information on the rotation of the drive shaft or information on the displacement thereof in the axial direction.

According to the drive shaft structure, the index mark is provided in the second surface of the drive shaft. Further, when the drive shaft and the seal member are disassembled and assembled, the seal member coming into close contact with the outer peripheral surface does not contact the second surface located closer to the inner side of the radial direction than the outer peripheral surface. For this reason, when the drive shaft and the seal member are disassembled and assembled, the seal member does not contact the index mark provided in the second surface.

(2) The second surface may be provided in a tapered the diameter of which gradually reduces from the outer peripheral surface.

(3) A fixed seat portion may be further provided around the second surface with a gap between the drive shaft and the fixed seat portion, and the fixed seat portion may include a reference mark which is used as a reference for the movement of the index mark.

(4) A turbo compressor according to another aspect of the invention includes: a casing in which a compressed gas flows; a flow rate control unit which adjusts the flow rate of the gas inside the casing; a drive unit which drives the flow rate control unit from the outside of the casing; and a drive shaft structure which transmits the drive force of the drive unit to the flow rate control unit, wherein the drive shaft structure according to (1) is used as the drive shaft structure.

(5) A turbo refrigerator according to still another aspect of the invention includes: a condenser which cools and liquefies a compressed refrigerant; an evaporator which evaporates the liquefied refrigerant and cools a cooling object by taking evaporation heat from the cooling object; and a compressor which compresses the refrigerant evaporated from the evaporator and supplies the refrigerant to the condenser, wherein the turbo compressor according to (4) is used as the compressor.

According to the invention, when the drive shaft and the seal member are disassembled and assembled, the seal member may be prevented from contacting the index mark provided in the second surface. For this reason, for example, even when the index mark is formed by a punch or the like and burrs are formed around the index mark, the seal member may be prevented from being damaged.

DETAILED DESCRIPTION OF THE INVENTION

Hereinafter, an exemplary embodiment of the invention will be described by referring to FIGS. 1 to 4. In the respective drawings used for the following description, the scales of the respective members are appropriately changed so that the respective members have recognizable sizes.

Figure 1:
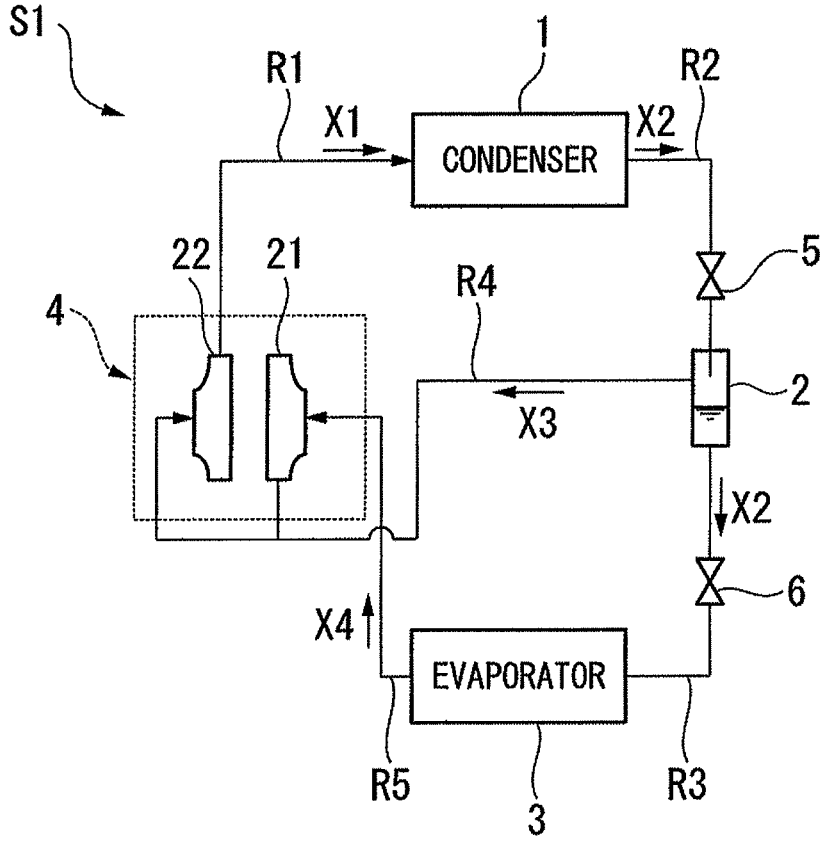
FIG. 1 is a block diagram illustrating a schematic configuration of a turbo refrigerator of an embodiment of the invention.

FIG. 1 is a block diagram illustrating a schematic configuration of a turbo refrigerator S1 of the embodiment. The turbo refrigerator S1 of the embodiment is provided at, for example, a building, a factory, or the like in order to generate air-conditioning cooling water. As shown in FIG. 1, the turbo refrigerator S1 includes a condenser 1, an economizer 2, an evaporator 3, and a turbo compressor 4.

A compressed refrigerant gas X1 as a compressed gas refrigerant is supplied to the condenser 1, and the compressed refrigerant gas X1 is cooled and liquefied so that it becomes a refrigerant liquid X2. Further, as shown in FIG. 1, the condenser 1 is connected to the turbo compressor 4 through a passage R1 where the compressed refrigerant gas X1 flows, and is connected to the economizer 2 through a passage R2 where the refrigerant liquid X2 flows. An expansion valve 5 is provided in the passage R2 so as to depressurize the refrigerant liquid X2.

The economizer 2 temporarily stores the refrigerant liquid X2 depressurized at the expansion valve 5. The economizer 2 is connected to the evaporator 3 through a passage R3 where the refrigerant liquid X2 flows, and is connected to the turbo compressor 4 through a passage R4 where a gas phase component X3 of the refrigerant generated at the economizer 2 flows. An expansion valve 6 is provided at the passage R3 so as to further depressurize the refrigerant liquid X2. Further, the passage R4 is connected to the turbo compressor 4 so as to supply the gas phase component X3 to a second compression stage 22 described later and provided in the turbo compressor 4.

The evaporator 3 cools a cooling object by taking evaporation heat from the cooling object such as water in a manner such that the refrigerant liquid X2 evaporates. The evaporator 3 is connected to the turbo compressor 4 through a passage R5 where a refrigerant gas X4 generated by the evaporation of the refrigerant liquid X2 flows. The passage R5 is connected to a first compression stage 21 described later and provided in the turbo compressor 4.

The turbo compressor 4 compresses the refrigerant gas X4 so that it becomes the compressed refrigerant gas X1. As described above, the turbo compressor 4 is connected to the condenser 1 through the passage R1 where the compressed refrigerant gas X1 flows, and is connected to the evaporator 3 through the passage R5 where the refrigerant gas X4 flows.

In the turbo refrigerator S1 having the above-described configuration, the compressed refrigerant gas X1 supplied to the condenser 1 through the passage R1 is cooled and liquefied by the condenser 1 so that it becomes the refrigerant liquid X2. The refrigerant liquid X2 is depressurized by the expansion valve 5 when it is supplied to the economizer 2 through the passage R2, and is temporarily stored in a depressurized state at the economizer 2. Subsequently, the refrigerant liquid X2 is further depressurized by the expansion valve 6 when it is supplied to the evaporator 3 through the passage R3, and is supplied to the evaporator 3 in a further depressurized state. The refrigerant liquid X2 supplied to the evaporator 3 is evaporated by the evaporator 3 so that it becomes the refrigerant gas X4, and is supplied to the turbo compressor 4 through the passage R5. The refrigerant gas X4 supplied to the turbo compressor 4 is compressed by the turbo compressor 4 so that it becomes the compressed refrigerant gas X1, and is supplied again to the condenser 1 through the passage R1. Further, a gas phase component X3 of the refrigerant is generated when the refrigerant liquid X2 is stored in the economizer 2. The gas phase component X3 is supplied to the turbo compressor 4 through the passage R4, and is compressed together with the refrigerant gas X4 so that it is supplied as the compressed refrigerant gas X1 to the condenser 1 through the passage R1.

That is, in the turbo refrigerator S1, the cooling object is cooled or frozen in a manner such that the refrigerant liquid X2 takes evaporation heat from the cooling object when evaporating from the evaporator 3.

Figure 2:
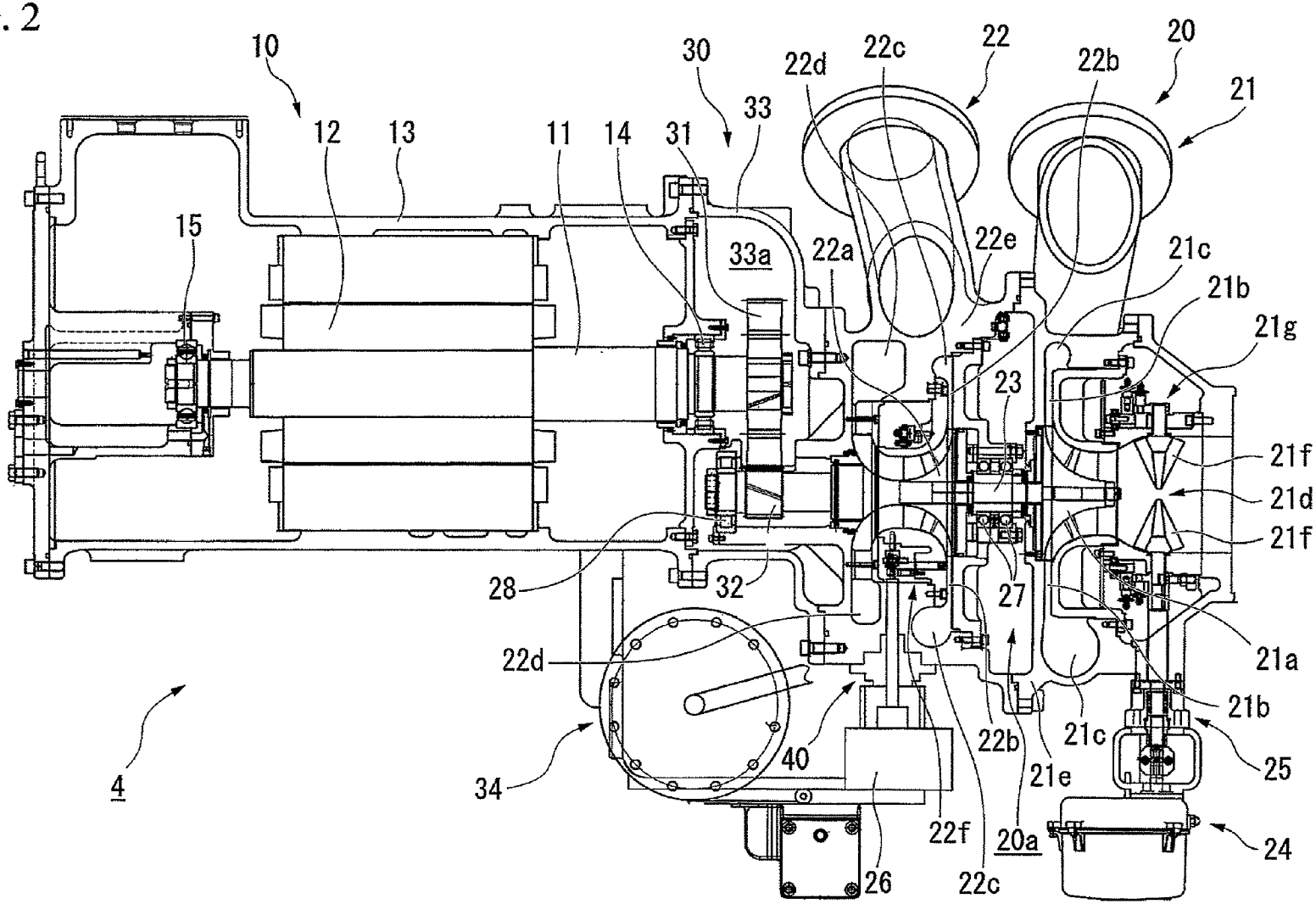
FIG. 2 is a horizontal cross-sectional view illustrating a turbo compressor of the embodiment of the invention.

Next, the turbo compressor 4 will be described in more detail. FIG. 2 is a horizontal cross-sectional view illustrating the turbo compressor 4 of the embodiment. As shown in FIG. 2, the turbo compressor 4 of the embodiment includes a motor unit 10, a compressor unit 20, and a gear unit 30.

The motor unit 10 includes a motor 12 which includes an output shaft 11 and serves as a drive source driving the compressor unit 20, and a motor casing 13 which surrounds the motor 12 and in which the motor 12 is provided. A drive source driving the compressor unit 20 is not limited to the motor 12, and may be, for example, an internal combustion engine. The output shaft 11 of the motor 12 is rotatably supported by a first bearing 14 and a second bearing 15 fixed to the motor casing 13.

The compressor unit 20 includes the first compression stage 21 which suctions and compresses the refrigerant gas X4 (refer to FIG. 1), and the second compression stage 22 which further compresses the refrigerant gas X4 compressed at the first compression stage 21 and discharges it as the compressed refrigerant gas X1 (refer to FIG. 1).

The first compression stage 21 includes a first impeller 21*a* which discharges the refrigerant gas X4 in the radial direction by applying velocity energy to the refrigerant gas X4 supplied in the thrust direction, a first diffuser 21*b* which compresses the refrigerant gas X4 by converting the velocity energy applied to the refrigerant gas X4 into pressure energy by the first impeller 21*a*, a first scroll chamber 21*c* which guides the refrigerant gas X4 compressed by the first diffuser 21*b* to the outside of the first compression stage 21, and a suction port 21*d* which supplies the refrigerant gas X4 to the first impeller 21*a* by suctioning the refrigerant gas X4. The first diffuser 21*b*, the first scroll chamber 21*c*, and the suction port 21*d* are formed by a first impeller casing 21*e* surrounding the first impeller 21*a*.

A rotation shaft 23 is provided inside the compressor unit 20 so as to extend across the first compression stage 21 and the second compression stage 22. The first impeller 21*a* is fixed to the rotation shaft 23, and rotates when rotation power is transmitted from the motor 12 to the rotation shaft 23.

A plurality of inlet guide vanes 21*f* is provided in the suction port 21*d* of the first compression stage 21 so as to adjust the suction amount of the first compression stage 21. Each inlet guide vane 21*f* is rotatably supported by the drive mechanism 21*g* fixed to the first impeller casing 21*e* so that a visible area in the stream direction of the refrigerant gas X4 is changeable. Further, a first drive unit 24, such as a motor, is provided at the outside of the first impeller casing 21*e* so that the first drive unit is connected to the drive mechanism 21*g* and rotates each inlet guide vane 21*f*. The first drive unit 24 is connected to the drive mechanism 21*g* through a first drive shaft structure 25. The first drive shaft structure 25 includes a drive shaft transmitting the drive force of the first drive unit 24 to the drive mechanism 21*g* and a seal member preventing the refrigerant gas X4 from leaking from the periphery of the drive shaft.

The second compression stage 22 includes a second impeller 22*a* which discharges the refrigerant gas X4 in the radial direction by applying velocity energy to the refrigerant gas X4 compressed at the first compression stage 21 and supplied in the thrust direction, a second diffuser 22*b* which compresses and discharges the compressed refrigerant gas X1 by converting the velocity energy applied to the refrigerant gas X4 into pressure energy by the second impeller 22*a*, a second scroll chamber 22*c* which guides the compressed refrigerant gas X1 discharged from the second diffuser 22*b* to the outside of the second compression stage 22, and an introduction scroll chamber 22*d* which guides the refrigerant gas X4 compressed by the first compression stage 21 to the second impeller 22*a*. The second diffuser 22*b*, the second scroll chamber 22*c*, and the introduction scroll chamber 22*d* are formed by a second impeller casing (casing) 22*e* surrounding the second impeller 22*a*.

The second impeller 22*a* is fixed to the rotation shaft 23 so that the rear surface thereof is coupled to the rear surface of the first impeller 21*a*, and rotates when the rotation power is transmitted from the motor 12 to the rotation shaft 23. The second scroll chamber 22*c* is connected to the passage R1 (refer to FIG. 1) supplying the compressed refrigerant gas X1 to the condenser 1 (refer to FIG. 1), and supplies the compressed refrigerant gas X1 guided from the second compression stage 22 to the passage R1.

A flow rate control unit 22*f* is provided around the second diffuser 22*b* in the second impeller casing 22*e* to adjust the flow rate of the compressed refrigerant gas X1 flowing inside the second diffuser 22*b*. The flow rate control unit 22*f* is formed in an annular shape surrounding the second impeller 22*a*, and may adjust the passage width of the second diffuser 22*b*. That is, due to the functions of the inlet guide vane 21*f* and the flow rate control unit 22*f*, the compressing performance of the turbo compressor 4 may be adjusted and the freezing performance of the turbo refrigerator S1 may be adjusted. Furthermore, a second drive unit 26 (a drive unit), such as a motor, is provided at the outside of the second impeller casing 22*e* to drive the flow rate control unit 22*f*. The second drive unit 26 is connected to the flow rate control unit 22*f* through a second drive shaft structure 40 (a drive shaft structure). The second drive shaft structure 40 is used to transmit the drive force of the second drive unit 26 to the flow rate control unit 22*f*, and the detailed configuration thereof will be described in detail later.

In addition, the first scroll chamber 21*c* of the first compression stage 21 and the introduction scroll chamber 22*d* of the second compression stage 22 are connected to each other through an external pipe (not shown) that is provided separately from the first compression stage 21 and the second compression stage 22. The refrigerant gas X4 compressed at the first compression stage 21 is supplied to the second compression stage 22 through the external pipe. The passage R4 (refer to FIG. 1) is connected to the external pipe, and the gas phase component X3 of the refrigerant generated at the economizer 2 is supplied to the second compression stage 22 through the external pipe.

The rotation shaft 23 is rotatably supported in a space 20*a* between the first compression stage 21 and the second compression stage 22 through a third bearing 27 fixed to the second impeller casing 22*e* and a fourth bearing 28 fixed to the end portion at the side of the motor unit 10 in the second impeller casing 22*e*.

The gear unit 30 is used to transmit the rotation power of the motor 12 to the rotation shaft 23, and includes a spur gear 31 which is fixed to the output shaft 11, a pinion gear 32 which is fixed to the rotation shaft 23 and meshes with the spur gear 31, and a gear casing 33 which accommodates the spur gear 31 and the pinion gear 32.

The spur gear 31 has a larger external diameter than that of the pinion gear 32, and the rotation power of the motor 12 is transmitted to the rotation shaft 23 so that the rpm of the rotation shaft 23 increases with respect to the rpm of the output shaft 11 due to the cooperation of the spur gear 31 and the pinion gear 32. Furthermore, the method of transmitting the rotation power of the motor 12 is not limited to the above-described transmission method. For example, a plurality of gears may be set to have different diameters so that the rpm of the rotation shaft 23 is equal to or lower than the rpm of the output shaft 11.

The gear casing 33 is molded separately from the motor casing 13 and the second impeller casing 22*e*, and connects them to each other. An accommodation space 33*a* is formed inside the gear casing 33 to accommodate the spur gear 31 and the pinion gear 32 therein. An oil tank 34 is provided in the gear casing 33 to collect and store lubricant supplied to the sliding portion of the turbo compressor 4.

Figure 3:
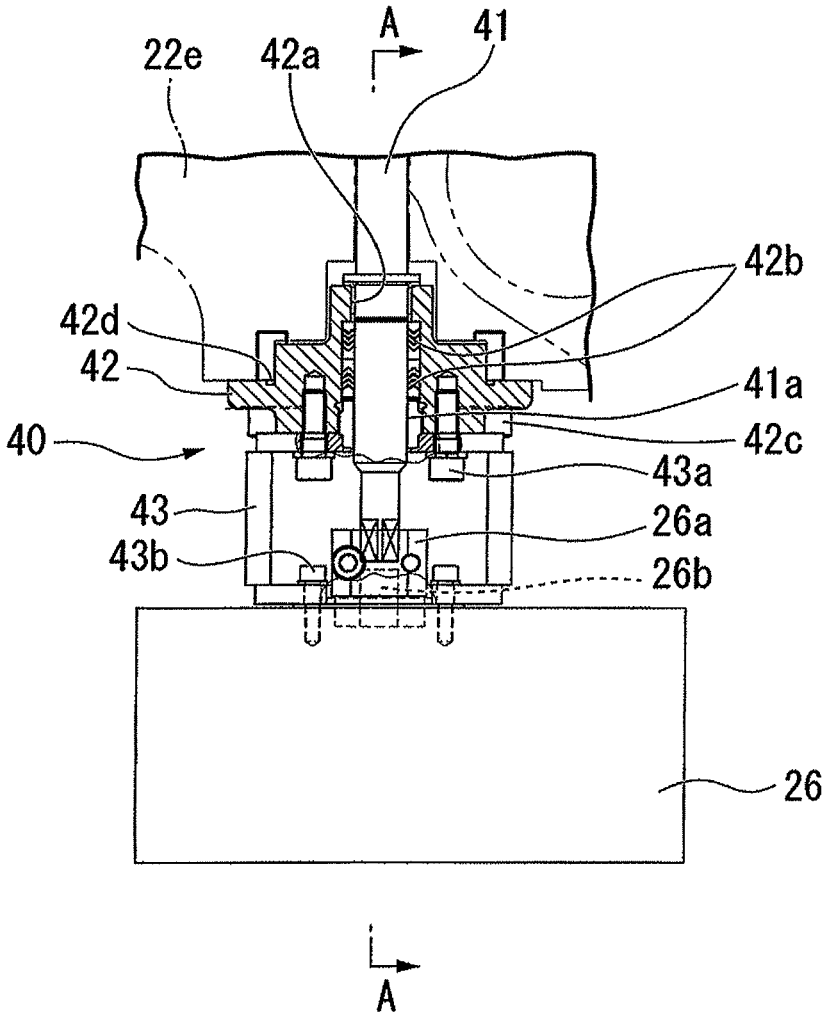
FIG. 3 is an enlarged horizontal cross-sectional view illustrating a second drive shaft structure of FIG. 2.
Figure 4B:
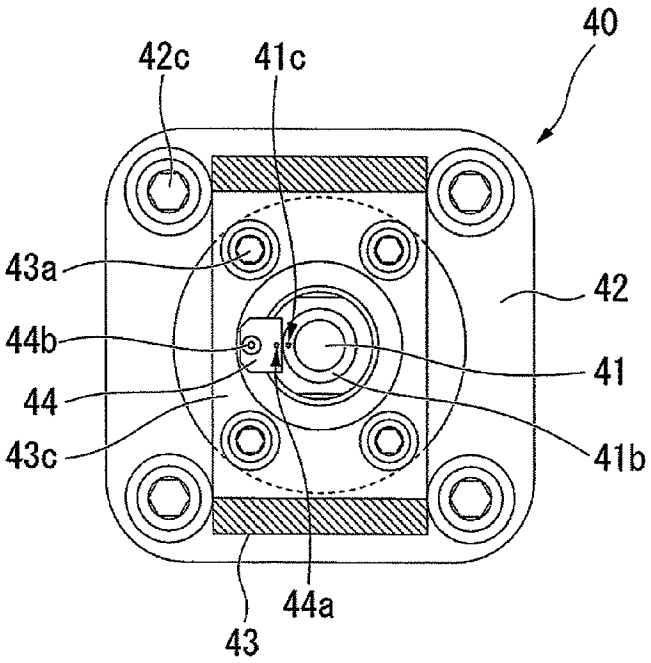
FIG. 4B is a schematic diagram illustrating the second drive shaft structure of the embodiment of the invention.
Figure 4A:
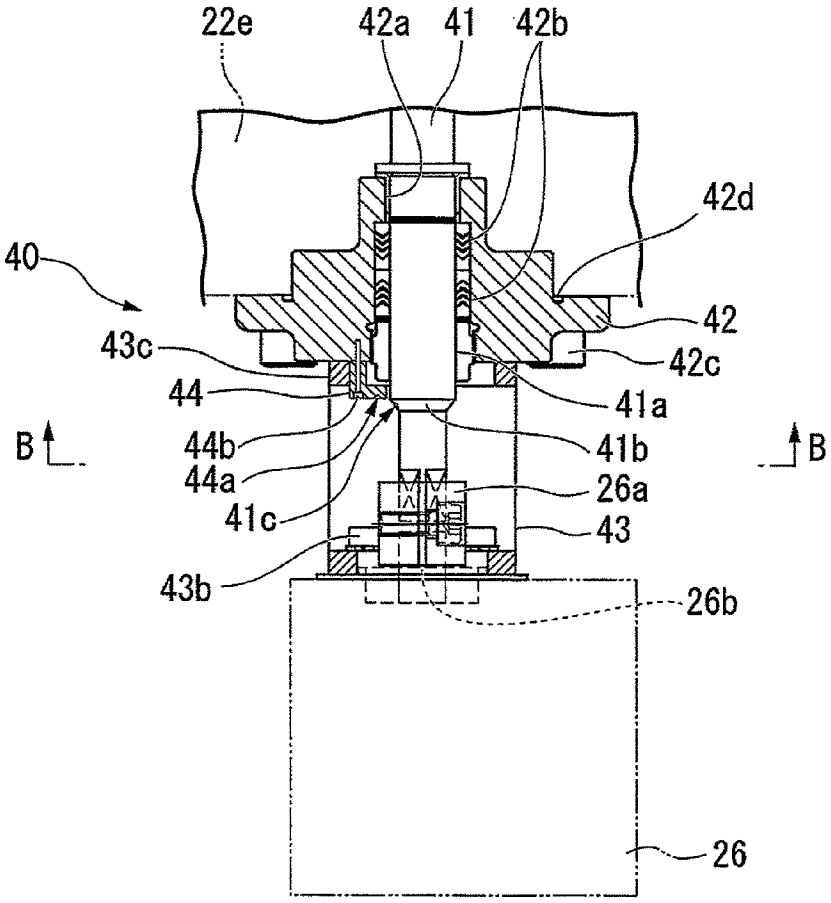
FIG. 4A is a schematic diagram illustrating the second drive shaft structure of the embodiment of the invention.

Next, the characteristic second drive shaft structure 40 of the embodiment will be described in more detail. FIG. 3 is an enlarged horizontal cross-sectional view illustrating the second drive shaft structure 40 of FIG. 2. Further, FIGS. 4A and 4B are schematic diagrams illustrating the second drive shaft structure 40 of the embodiment. FIG. 4A is a cross-sectional view taken along the line A-A of FIG. 3, and FIG. 4B is a cross-sectional view taken along the line B-B of FIG. 4A. As shown in FIG. 3, the second drive shaft structure 40 includes a drive shaft 41 and a stepping box 42.

The drive shaft 41 is a shaft member that transmits the drive force of the second drive unit 26 to the flow rate control unit 22*f* (refer to FIG. 2). The end portion at the side of the second drive unit 26 in the drive shaft 41 is fixed to a second output shaft 26*b* of the second drive unit 26 through a connector 26*a*. Further, although not shown in the drawings, the end portion at the side of the flow rate control unit 22*f* in the drive shaft 41 is fixed to a drive mechanism (not shown) of the flow rate control unit 22*f*.

The stepping box 42 rotatably supports the drive shaft 41 and prevents the compressed refrigerant gas X1 (refer to FIG. 1) from leaking from the periphery of the drive shaft 41. The stepping box 42 includes a penetration hole 42*a* that allows the drive shaft 41 to penetrate the hole. A packing 42*b* (a seal member) is disposed at the inner peripheral surface side of the penetration hole 42*a* to keep the air-tightness of the gap between the outer peripheral surface 41*a* (the first surface) of the drive shaft 41 and the penetration hole 42*a*. The packing 42*b* is formed in an annular shape surrounding the drive shaft 41, and is provided to come into close contact with the outer peripheral surface 41*a* of the drive shaft 41.

Further, the stepping box 42 is fixed to the second impeller casing 22*e* by a plurality of first bolts 42*c*. A gasket 42*d* as a seal member is provided between the stepping box 42 and the second impeller casing 22*e* to prevent the leakage of the compressed refrigerant gas X1. By the cooperation of the packing 42*b* and the gasket 42*d*, the compressed refrigerant gas X1 may be prevented from leaking from the periphery of the drive shaft 41.

Furthermore, the stepping box 42 is also used to fix the second drive unit 26 to the second impeller casing 22*e*. The second drive unit 26 is connected and fixed to the stepping box 42 through a drive unit trestle 43. The drive unit trestle 43 is formed by connecting four flat members to each other in a rectangular frame shape. The drive unit trestle 43 is fixed to the stepping box 42 by a plurality of bolts 43*a*, and is fixed to the second drive unit 26 by a plurality of third bolts 43*b*. That is, the second drive unit 26 is connected and fixed to the second impeller casing 22*e* through the stepping box 42 and the drive unit trestle 43.

As shown in FIGS. 4A and 4B, the drive shaft 41 includes a tapered portion 41*b* (a second surface) of which the diameter gradually decreases from the outer peripheral surface 41*a* (the first surface) toward the second drive unit 26. That is, the tapered portion 41*b* is located closer to the inner side of the radial direction than the outer peripheral surface 41*a*. The tapered portion 41*b* is provided with an index mark 41*c* which is used to confirm the information on the rotation of the drive shaft 41. The index mark 41*c* is formed by, for example, a punch to have a hole shape recessed from the surface of the tapered portion 41*b*. Burrs may be formed around the index mark 41*c* formed by the punch.

Further, the second drive shaft structure 40 includes a fixed seat portion 44 which is provided in the stepping box 42. The fixed seat portion 44 is provided around the index mark 41*c* in the tapered portion 41*b* to have a gap between the drive shaft 41 and the fixed seat portion 44. A reference mark 44*a* is formed on the surface at the side of the second drive unit 26 in the fixed seat portion 44 so as to be used as a reference for the movement of the index mark 41*c*. As in the index mark 41*c*, the reference mark 44*a* is formed by, for example, a punch so as to have a hole shape recessed from the surface of the fixed seat portion 44. The connection positions of the tapered portion 41*b* and the outer peripheral surface 41*a*, and the surface at the side of the second drive unit 26 in the fixed seat portion 44 are provided at the same position in the axial direction of the drive shaft 41. Furthermore, the fixed seat portion 44 is fixed to the stepping box 42 by a fourth bolt 44*b*.

The fixed seat portion 44 is provided around a flat portion 43*c* contacting the stepping box 42 in the flat member constituting the drive unit trestle 43. In the axial direction of the drive shaft 41, the fixed seat portion 44 is higher than the thickness of the flat portion 43*c*. Since the flat portion 43*c* and the fixed seat portion 44 are both provided at the same surface of the stepping box 42, the fixed seat portion 44 protrudes toward the second drive unit 26 more than the flat portion 43*c*.

Since the index mark 41*c* is formed in the tapered portion 41*b* of the drive shaft 41, it is possible to confirm the rotation of the drive shaft 41 while visually confirming the movement of the index mark 41*c*. Since the drive shaft 41 is connected to the flow rate control unit 22*f*, it is possible to externally confirm the operation of the flow rate control unit 22*f* provided inside the second impeller casing 22*e* while visually confirming the movement of the index mark 41*c*. Further, since the fixed seat portion 44 is provided around the index mark 41*c* in the tapered portion 41*b* and the reference mark 44*a* is provided in the fixed seat portion 44, it is possible to more accurately confirm the rotation (and the rotation angle) of the drive shaft 41 while visually confirming the movement of the index mark 41*c* on the basis of the reference mark 44*a*.

As described above, the fixed seat portion 44 protrudes toward the second drive unit 26 more than the flat portion 43*c* of the drive unit trestle 43. For this reason, the reference mark 44*a* or the index mark 41*c* may be visually confirmed from the outside without the interference of the flat portion 43*c*. That is, it is possible to improve the outward visibility of the reference mark 44*a* or the index mark 41*c*. Further, since the index mark 41*c* is provided in the tapered portion 41*b*, it is possible to further improve the visibility.

Further, for example, at the time of performing the maintenance of the turbo compressor 4, it is necessary to take out the drive shaft 41 from the penetration hole 42*a* of the stepping box 42 and disassemble and assemble again the drive shaft 41 and the packing 42*b* in order to confirm the interior of the turbo compressor 4. According to the embodiment, the index mark 41*c* may be provided in the tapered portion 41*b* of the drive shaft 41. That is, when the drive shaft 41 and the packing 42*b* are disassembled and assembled, the packing 42*b* coming into close contact with the outer peripheral surface 41*a* does not contact the tapered portion 41*b* located closer to the inner side of the radial direction than the outer peripheral surface 41*a*. For this reason, when the drive shaft 41 and the packing 42*b* are disassembled and assembled, the packing 42*b* does not contact the index mark 41*c* provided in the tapered portion 41*b*. Therefore, even when the index mark 41*c* is formed by a punch or the like and burrs are formed around the index mark 41*c*, the packing 42*b* may be prevented from being damaged.

Further, since the tapered portion 41*b* is provided in the drive shaft 41, it is possible to easily insert the drive shaft 41 into the packing 42*b* when assembling the drive shaft 41 and the stepping box 42 to each other. Therefore, it is possible to the packing 42*b* from being damaged when inserting the drive shaft 41 thereinto.

Next, an operation of the turbo compressor 4 of the embodiment will be described. First, the rotation power of the motor 12 is transmitted to the rotation shaft 23 through the spur gear 31 and the pinion gear 32. Accordingly, the first impeller 21*a* and the second impeller 22*a* of the compressor unit 20 rotate.

When the first impeller 21*a* rotates, the suction portion 21*d* of the first compression stage 21 enters a negative pressure state, the refrigerant gas X4 flows from the passage R5 into the first compression stage 21 through the suction port 21*d*. The refrigerant gas X4 flowing into the first compression stage 21 flows into the first impeller 21*a* in the thrust direction, and is discharged in the radial direction by applying velocity energy thereto by the first impeller 21*a*. The refrigerant gas X4 discharged from the first impeller 21*a* is compressed by converting velocity energy into pressure energy by the first diffuser 21*b*. The refrigerant gas X4 discharged from the first diffuser 21*b* is guided to the outside of the first compression stage 21 through the first scroll chamber 21*c*. Then, the refrigerant gas X4 guided to the outside of the first compression stage 21 is supplied to the second compression stage 22 through an external pipe (not shown).

The refrigerant gas X4 supplied to the second compression stage 22 flows into the second impeller 22*a* in the thrust direction through the introduction scroll chamber 22*d*, and is discharged in the radial direction by applying velocity energy thereto by the second impeller 22*a*. The refrigerant gas X4 discharged from the second impeller 22*a* is further compressed by converting velocity energy into pressure energy using the second diffuser 22*b*, so that it becomes the compressed refrigerant gas X1. The compressed refrigerant gas X1 discharged from the second diffuser 22*b* is guided to the outside of the second compression stage 22 through the second scroll chamber 22*c*. Then, the compressed refrigerant gas X1 guided to the outside of the second compression stage 22 is supplied to the condenser 1 through the passage R1.

In this way, the operation of the turbo compressor 4 is completed.

Therefore, according to the embodiment, it is possible to prevent the packing 42*b* from contacting the index mark 41*c* provided in the tapered portion 41*b* upon disassembling and assembling the drive shaft 41 and the packing 42*b*. For this reason, for example, even when the index mark 41*c* is formed by a punch or the like and burrs are formed around the index mark 41*c*, the packing 42*b* may be prevented from being damaged.

As mentioned above, although a preferable embodiment according to the present invention has been described with reference to the drawings, it is needless to say that the present invention is not limited to the related art. Overall shapes, combinations or the like of the respective members shown in the aforementioned examples, and can be variously changed in a scope of not depending from the gist of the present invention based on the design request or the like.

For example, in the above-described embodiment, the second drive shaft structure 40 is provided in the turbo compressor 4, but the invention is not limited thereto. For example, the second drive shaft structure 40 may be provided in a pressure container (may be used at least when there is a difference in pressure between the inside and the outside of the container).

Further, in the above-described embodiment, the second drive shaft structure 40 is used to transmit the drive force to the flow rate control unit 22*f*, but the invention is not limited thereto. For example, the second drive shaft structure 40 may be used instead of the first drive shaft structure 25 that transmits the drive force to the inlet guide vane 21*f* or the drive mechanism 21*g*.

Further, in the above-described embodiment, the index mark 41*c* or the reference mark 44*a* is used to confirm the information on the rotation of the drive shaft 41, but the invention is not limited thereto. For example, the index mark 41*c* or the reference mark 44*a* may be used to confirm the information on the displacement in the axial direction of the drive shaft 41.

What is claimed is:

1. A turbo compressor comprising:

a casing in which a compressed gas flows;

a flow rate control unit which adjusts the flow rate of the gas inside the casing;

a drive unit which drives the flow rate control unit from the outside of the casing; and a drive shaft structure configured to transmit a drive force of the drive unit to the flow rate control unit, the drive shaft structure comprising:

a drive shaft which transmits the drive force; and a seal member which is provided to come into close contact with the outer peripheral surface of the drive shaft, wherein the drive shaft includes a second surface located closer to the inner side of the radial direction than the outer peripheral surface, and the second surface includes an index mark used to confirm information on the rotation of the drive shaft or information on the displacement thereof in the axial direction.

2. The turbo compressor according to claim 1, wherein the second surface is provided in a tapered portion of which the diameter gradually reduces from the outer peripheral surface.

3. The turbo compressor according to claim 1, wherein the drive shaft structure further comprises:

a fixed seat portion which is provided around the second surface with a gap between the drive shaft and the fixed seat portion, wherein the fixed seat portion includes a reference mark which is used as a reference for the movement of the index mark.

4. The turbo compressor according to claim 2, wherein the drive shaft structure further comprises:

a fixed seat portion which is provided around the second surface with a gap between the drive shaft and the fixed seat portion, wherein the fixed seat portion includes a reference mark which is used as a reference for the movement of the index mark.

5. A turbo refrigerator comprising:

a condenser which cools and liquefies a compressed refrigerant;

an evaporator which evaporates the liquefied refrigerant and cools a cooling object by taking evaporation heat from the cooling object; and a compressor which compresses the refrigerant evaporated from the evaporator and supplies the refrigerant to the condenser, wherein the turbo compressor according to claim 1 is used as the compressor.

6. A turbo refrigerator comprising:

a condenser which cools and liquefies a compressed refrigerant;

an evaporator which evaporates the liquefied refrigerant and cools a cooling object by taking evaporation heat from the cooling object; and a compressor which compresses the refrigerant evaporated from the evaporator and supplies the refrigerant to the condenser, wherein the turbo compressor according to claim 2 is used as the compressor.

7. A turbo refrigerator comprising:

a condenser which cools and liquefies a compressed refrigerant;

an evaporator which evaporates the liquefied refrigerant and cools a cooling object by taking evaporation heat from the cooling object; and a compressor which compresses the refrigerant evaporated from the evaporator and supplies the refrigerant to the condenser, wherein the turbo compressor according to claim 3 is used as the compressor.

8. A turbo refrigerator comprising:

a condenser which cools and liquefies a compressed refrigerant;

an evaporator which evaporates the liquefied refrigerant and cools a cooling object by taking evaporation heat from the cooling object; and a compressor which compresses the refrigerant evaporated from the evaporator and supplies the refrigerant to the condenser, wherein the turbo compressor according to claim 4 is used as the compressor.

* * * * *